US010388260B2

(12) United States Patent
Schwarze et al.

(10) Patent No.: US 10,388,260 B2
(45) Date of Patent: Aug. 20, 2019

(54) METHOD FOR IMPROVING THE ACOUSTIC PROPERTIES OF SPRUCE RESONANCE WOOD

(71) Applicant: EMPA Eidgenoessische Materialpruefungs- und Forschungsanstalt, Duebendorf (CH)

(72) Inventors: Francis Schwarze, Niederteufen (CH); Markus Heeb, Zurich (CH); Marjan Gilani, Duebendorf (CH); Sebastien Josset, Duebendorf (CH)

(73) Assignee: EMPA Eidgenoessische Materiapruefungs- und Forschungsanstalt, Duebendorf (CH)

( * ) Notice: Subject to any disclaimer, the term of this patent is extended or adjusted under 35 U.S.C. 154(b) by 0 days.

(21) Appl. No.: 16/065,819

(22) PCT Filed: Dec. 28, 2016

(86) PCT No.: PCT/EP2016/082761

§ 371 (c)(1),
(2) Date: Dec. 4, 2018

(87) PCT Pub. No.: WO2017/114856

PCT Pub. Date: Jul. 6, 2017

(65) Prior Publication Data

US 2019/0088235 A1 Mar. 21, 2019

(30) Foreign Application Priority Data

Dec. 30, 2015 (EP) ..... 15203220
Apr. 11, 2016 (EP) ..... 16164755

(51) Int. Cl.
*G10D 1/00* (2006.01)

(52) U.S. Cl.
CPC ..... *G10D 1/005* (2013.01)

(58) Field of Classification Search
CPC combination set(s) only.
See application file for complete search history.

(56) References Cited

U.S. PATENT DOCUMENTS 6,657,113 B2 * 12/2003 Herman ..... G10D 1/005 84/293
7,598,444 B2 * 10/2009 Farnell, Jr. ..... B29C 44/12 84/291
7,700,862 B2 4/2010 Schwarze et al.

FOREIGN PATENT DOCUMENTS

EP 1734504 A1 12/2006
WO 2012056109 A2 5/2012

OTHER PUBLICATIONS

Franziska Grüneberger et al: Nanofibrillated cellulose in wood coatings: mechanical properties of free composite films,Journal of Materials Sci Ence, vol. 49, No. 18, Jun. 18, 2014 (Jun. 18, 2014) , pp. 6437-6448.

(Continued)

*Primary Examiner* — Kimberly R Lockett
(74) *Attorney, Agent, or Firm* — Agris & Von Natzmer, LLP; Joyce Von Natzmer

(57) ABSTRACT

In a method for improving the acoustic properties of spruce resonance wood for musical instruments at least one resonance wood blank is subjected to a treatment with *Physisporinus vitreus* under controlled, sterile conditions. The previously sterilized resonance wood blank is immersed into a liquid medium enriched with fungus myecelium and kept therein in the dark for an exposure time and finally sterilized, wherein during the exposure time a temperature of 18 to 26° C. and a relative humidity of approximately 60 to approximately 80% are maintained. Due to the fact that the liquid medium contains nanofibrillated cellulose (NFC) in an amount of 200 to 300 g per liter, a reproducible, uniform (Continued)

improvement of the acoustic properties of the resonance wood free from local defects is ensured.

20 Claims, 6 Drawing Sheets

(56) References Cited

OTHER PUBLICATIONS

Fuhr M J et al: Automated quantification of the impact of the wood-decay fungus on the cell wall structure of Norway spruce by tomographic microscopy, Wood Science and Technology, Journal of the International Academy of Wood Science, Springer, Berlin, DE, vol. 46, No. 4,Aug. 26, 2011 (Aug. 26, 2011) , pp. 769-779.
Lehringer C et al: Anatomy of bioincised Norway spruce wood, International Biodeterioration and Biodegradation, Elsevi Er Ltd, GB, vol. 64, No. 5, Aug. 1, 2010 (Aug. 1, 2010), pp. 346-355.
Schwarze Francis W M R et al: Superior wood for violins—wood decay fungi as a substitute for cold climate, New Phytologist, Cambridge University Press, Cambridge, GB, vol. 179, No. 4,Sep. 1, 2008 (Sep. 1, 2008) , pp. 1095-1104.
Schubert et al: Determination of optimal growth parameters for the bioincising fungus Physisporinus vitreus by means of response surface methodology, Journal of Applied Microbiology, 106 (2009), pp. 1734-1742.

* cited by examiner

METHOD FOR IMPROVING THE ACOUSTIC PROPERTIES OF SPRUCE RESONANCE WOOD

CROSS-REFERENCE TO RELATED APPLICATIONS

This is the U.S. national stage of International application PCT/EP2016/082761, filed Dec. 28, 2016 designating the United States and claiming priority to EP 15203220.7, filed Dec. 30, 2015 and EP16164755.7, filed Apr. 11, 2016.

TECHNICAL FIELD

The invention relates to a method for improving the acoustic properties of spruce resonance wood for musical instruments. Moreover, the invention relates to an improved spruce resonance wood for musical instruments, and also to musical instruments, in particular to bowed instruments whose resonance plates consist of such spruce resonance wood.

BACKGROUND OF THE INVENTION

Acoustic wood for musical instruments (so called resonance wood) should be as light as possible but at the same time have a high modulus of elasticity (E-modulus or Young's modulus, respectively) and a high speed of sound. Moreover, it should be free of knots and have narrow, homogeneous annual rings and a low proportion of latewood (<20%). Only a few, carefully selected wood assortments meet these strict quality criteria.

Musical instruments which were built during the late 17th and early 18th centuries in many cases have better quality characteristics than contemporary instruments. One of the hypotheses for explaining this difference attributes the particular wood quality of these instruments to the climate situation known as the Maunder minimum, which prevailed between 1645 and 1715 and in which longer winters and colder summers evidently resulted in a slower and more uniform wood formation and thus provoked a smaller proportion of latewood. In the last decades of his work (the so-called "golden era"), the famous violin maker Antonio Stradivari mainly used spruce wood of trees that had grown during the Maunder minimum. These instruments have long been regarded as a sound ideal that has only rarely been achieved again.

The (acoustic) material quality of resonance wood is generally defined by the quotient c/p, wherein c is the speed of sound and p is the raw density of the resonance wood (Ono & Norimoto, 1983; 1984; Spycher, 2008; Spycher et al., 2008; Tab. 4). The speed of sound corresponds to the square root of the ratio of the E-modulus (for bending longitudinally to the fiber) to the density. The E-modulus is a material parameter which is independent of geometry; the product of E-modulus and area moment of inertia yields the flexural rigidity of the workpiece (Ono & Norimoto, 1983; 1984; Spycher, 2008; Spycher et al., 2008). The speed of sound of e.g. spruce wood in the longitudinal direction is 4800 to 6200 m/s, the average raw density is 320 to 420 kg/m$^3$. Both parameters, like many other wood properties, depend on the moisture content of the wood, which increases the requirements regarding precision and infrastructure of the experiments, but also regarding the evaluation of test results. Of particular interest for all measures aiming to improve material quality is the impact that relative changes in modulus and raw density have on the speed of sound. If for a specific measure the E-modulus (in %) changes approximately proportionally to the change in raw density (in %), then the speed of sound will remain approximately the same (the material quality will then increase approximately inversely proportional to a reduction in raw density); such a ratio of relative changes in the E-modulus and raw density is called "narrow" (Ono & Norimoto, 1983; 1984; Spycher, 2008; Spycher et al., 2008). If, on the other hand, the E-modulus (in %) decreases significantly less than the raw density (in %), then the speed of sound will increase (the material quality will then increase more than inversely proportional to a reduction in raw density). Such a ratio of relative changes in the E-modulus and raw density is called "wide" or "large" and is highly desirable for achieving a high material quality of resonance wood (Schleske, 1998; Wegst, 2006). However, resonance wood with a wide E-modulus to raw density ratio is rarely found in nature and accordingly is expensive (Bond, 1976; Bucur, 2006).

Various methods for improving the acoustic properties of resonance wood have been tried. In particular, it has been proposed in EP 1734504 A1 to expose the resonance wood to the action of a wood-decomposing fungus species during a limited treatment time. In doing so, the fungus species and the duration of treatment should be chosen in such manner that, on the one hand, the treatment achieves an increase in the ratio between speed of sound of the wood and raw density of the wood and, on the other hand, strength values of the resonance wood do not fall below a predetermined minimum. Fungal species used were *Asco-* and *Basidiomycetes* from the family of Leotiaceae, Polyporaceae, Schizophyllaceae, Trichlomataceae and Xylariaceae. To perform the method, a feedboard method was used in which the resonance wood to be treated is placed between two fungus-infected woods with the same dimensions.

Subsequently, extensive investigations have shown that compared to the method according to EP 1734504 A1 a more pronounced improvement of the resonance wood would be desirable. In particular, it was found that none of the proposed fungus species is able to increase the damping factor of the resonance wood. An increase in the damping factor while simultaneously improving the acoustic material quality reduces the high tones of the instrument, which often sound painful to the listener.

In this regard, it has surprisingly been found that by means of a treatment with *Physisporinus vitreus* an improvement of the above mentioned acoustic material quality values while simultaneously increasing the damping factor can be achieved, whereby an overall improvement in the acoustic properties is obtained (Schwarze, F. W. M. R., Spycher, M., Fink, S. (2008) Superior wood for violins—wood decay fungi a substitute for cold climate. New Phytologist 179, 1095-1104).

A disadvantage of the methods described so far is that a uniform colonization of the wood can not be guaranteed by the selected fungus species. An irregular colonization has the consequence that the acoustic material quality is improved only inconsistently or not at all. Moreover, it entails the risk of undesirable strength losses, cracks and crevices in the wood. Moreover, it has been found that *Physisporinus vitreus* has a low level of competitivity with other fungus species and is, therefore, very susceptible to contamination by other species.

In the technical article Fuhr, M. J. et al. (2012) Automated quantification of the impact of the wood-decay fungus *Physisporinus vitreus* on the cell wall structure of Norway spruce by tomographic microscopy. Wood Sci Technol 46,769-779, there is described a method of automatic visualization and quantification of microscopic cell wall elements of spruce wood, which is also able to show the changes caused by *Physisporinus vitreus*.

WO2012/056109 A2 describes the use of plant-derived nanofibrillated cellulose in the form of a hydrogel or a membrane as a carrier material for various types of cell cultures.

DESCRIPTION OF THE INVENTION

The object of the invention is to provide an improved method for the production of spruce resonance wood for musical instruments, which in particular ensures an improvement of the acoustic properties, a shorter processing time and a more homogeneous product. Further objects of the invention are to provide an improved resonance wood for musical instruments, and also musical instruments made therefrom.

These objects are achieved according to the present invention by the method specified in claim 1, by the resonance wood defined in claim 10 and also by the musical instrument defined in claim 11.

According to a first aspect of the invention, a resonance wood blank is subjected to a treatment with *Physisporinus vitreus* under controlled, sterile conditions for improving the acoustic properties of spruce resonance wood for musical instruments. Thereby, the previously sterilized resonance wood blank is immersed into a liquid medium enriched with fungus mycelium and kept therein in the dark during an exposure time and finally sterilized. The liquid medium contains nanofibrillated cellulose (NFC) in an amount of 200 to 300 g per liter. "Controlled, sterile conditions" shall be understood in the present context as an environment in which at least the temperature and the relative humidity are kept within a predefined range and contamination with extraneous fungal species is prevented. According to the present invention, a temperature of 18 to 26° C. and a relative humidity of about 60 to about 80% is adjusted.

The initial sterilization and subsequent treatment with *Physisporinus vitreus* under sterile conditions in a suitable incubation container ensures that the process is not affected by contamination. The final sterilization stops the effect of *Physisporinus vitreus* in a controlled manner. Due to the fact that the liquid medium contains nanofibrillated cellulose (NFC) in an amount of 200 to 300 g per liter, a significantly improved efficiency of the process is achieved, which thus occurs much faster and more homogeneously.

Through the measures of the present invention, a reproducible, uniform improvement of the acoustic properties of the resonance wood free from local defects is ensured.

A resonance wood blank is generally understood to be a plate-shaped section of a suitable resonance wood, which is intended, in particular, for producing the soundboard or the backplate of a bowed or plucked instrument. In the present context, it is without exception spruce wood.

For use as an incubation container to carry out processes under sterile conditions, a closeable medium-tight container made of sterilizable materials, for example made of a plastic suitable for autoclaving, is generally suitable. Furthermore, the container must be equipped in such manner that a controlled atmosphere with a predetermined humidity can be adjusted inside. For the controlled supply of air, at least one valve equipped with a sterile microfilter is provided.

A liquid medium enriched with fungal mycelium is understood in known manner to be a buffered aqueous solution with nutrients, to which have been admixed mycelium samples of a pure culture of *Physisporinus vitreus* and then cultivated for a suitable time.

According to the present invention, the liquid medium contains an amount of 200 to 300 g nanofibrillated cellulose (NFC) per liter of liquid medium. In the present context the term "nanofibrillated cellulose", also abbreviated as "NFC", shall be understood as cellulose fibers having a diameter of about 3 nm to about 200 nm and a length of at least 500 nm and an aspect ratio (length:diameter) of at least 100. Typically, the NFC fibers have a diameter of 10 to 100 nm, on average 50 nm, and a length of at least a few micrometers, and the aspect ratio may also be 1'000 or more. NFC is generally obtained by a mechanical comminution process from wood and other vegetable fibers; first descriptions go back to Herrick et al. (Herrick, F. W.; Casebier, R. L.; Hamilton, J. K.; Sandberg, K. R. Microfibrillated cellulose: Morphology and accessibility. J. Appl. Polym. Sci. Appl. Polym. Symp. 1983, 37, 797-813) and Turback et al. (Turbak, A. F.; Snyder, F. W.; Sandberg, K. R. Microfibrillated cellulose, a new cellulose product: Properties, uses, and commercial potential. J. Appl. Polym. Sci. Appl. Polym. Symp. 1983, 37, 815-827) in the year 1983. The new material was initially called microfibrillated cellulose (MFC). Nowadays, however, various other terms such as cellulose nanofibers (CNF), nanofibrillated cellulose (NFC) and cellulose nano- or microfibrils are commonly used beside the term MFC. This is a semi-crystalline cellulose-containing material made of cellulose fibers with a high aspect ratio (=ratio of length to diameter), lower degree of polymerization as compared with intact plant fibers and correspondingly increased surface area, which is obtained for example by a homogenization or grinding process (Andresen, M.; Johansson, L. S.; Tanem, B. S.; Stenius, P. Properties and characterization of hydrophobized microfibrillated cellulose. Cellulose 2006, 13, 665-677). In contrast to straight-line "cellulose whiskers", which are also referred to as "cellulose nanocrystals" and which have a rod-shaped shape with a length of usually 100 to 500 nm (depending on cellulose source, there are also crystals with a length of up to 1 μm), the cellulose nanofibers are long and flexible. The NFC formed therefrom typically contains crystalline and amorphous domains and has a network structure due to strong hydrogen bonding (siehe z.B. Lu, J.; Askeland, P.; Drzal, L. T. Surface modification of microfibrillated cellulose for epoxy composite applications. Polymer 2008, 49, 1285-1298; Zimmermann, T.; Pöhler, E.; Geiger, T. Cellulose fibrils for polymer reinforcement. Adv. Eng. Mat. 2004, 6, 754-761, Iwamoto, S.; Kai, W.; Isogai, A.; Iwata, T. Elastic modulus of single cellulose microfibrils from tunicate measured by atomic force microscopy. Biomacromolecules 2009, 10, 2571-2576).

It will be understood that the method according to the present invention, can be carried out, in principle, with a single blank of resonance wood. As a rule, however, just for the sake of efficiency, several resonance wood blanks are treated simultaneously. For this purpose, the incubation container is conveniently designed with corresponding recesses and support elements. Conveniently, the method can be carried out in particular with two resonance wood blanks, which together form a cover for a violin.

Preferred embodiments of the method are defined in the dependent claims.

Advantageously, the treatment is carried out with *Physisporinus vitreus* EMPA 642 (claim 2).

Advantageously, during the exposure time, a temperature of about 22° C., particularly in the range of 21° C. to 23° C., and a relative humidity of about 70%, particularly in the range of 65 to about 75%, are maintained (claim 3).

When carrying out the method, the exposure time is preferably chosen in such manner that the resonance wood has the following strength values (claim 4):

a module for bending longitudinally to the fiber of at least 7 GPa, preferably of at least 10 GPa;

a compressive strength longitudinally to the fiber of at least 24 $N/mm^2$, preferably of at least 34 $N/mm^2$; and a compressive strength transversely to the fiber of at least 3 $N/mm^2$, preferably of at least 4.2 $N/mm^2$.

Through the measures of the present invention, the production of resonance wood with excellent properties using a comparatively short exposure time of 4 to 6 months becomes possible (claim 5).

The liquid medium used for the process according to the present invention is preferably obtained by incubation of an NFC-containing nutrient medium inoculated with *Physisporinus vitreus* under controlled pH conditions (claim 6). Advantageously, for this process an aqueous nutrient medium with spruce wood extract and nanofibrillated cellulose is initially introduced and inoculated with a fungus-containing liquid medium culture or with fungus-covered sawdust particles.

In principle, the sterilization of the resonance wood blank, which is to be carried out after the exposure time of several months, can be carried out in a known manner. Preferably, ethylene oxide is used for this purpose (claim 7).

As a result of the method according to the present invention, there is an increase in the color index of the treated resonance wood blanks. Preferably, the color index E* defined in the color space (L*, a*, b*) is increased by at least 14 (claim 8). Moreover, advantageously, a color change of the wood is effected which is characterized by a color distance ΔE* defined in the color space (L*, a*, b*) of at least 11 (claim 9).

According to a further aspect of the invention, the spruce resonance wood for musical instruments which is produced by the method according to the present invention is characterized by the fact that, compared to untreated resonance wood, the sound emission in longitudinal direction is increased by at least 20%, preferably by at least 24%, and the damping in longitudinal direction is increased by at least 25%, preferably by at least 29%. As generally usual in connection with wood, a distinction is made also in the present case between "longitudinal", "radial" and "tangential direction". The longitudinal direction corresponds to the direction of tree growth, while the radial and tangential directions refer to the approximately circular tree rings. For resonance wood the properties in the longitudinal direction are particularly important for its acoustic properties, in particular also for the sound quality of a violin.

A still further aspect of the present invention relates to a musical instrument, in particular a bowed instrument, comprising at least one resonance plate made of improved spruce resonance wood according to the present invention. In the present context, "musical instrument" is to be understood in the broadest sense; in particular, such resonance plates can also be used for wooden membranes in loudspeaker boxes.

BRIEF DESCRIPTION OF THE DRAWINGS

Examples of the invention will henceforth be described in more detail by reference to the drawings, which show.

MODES FOR CARRYING OUT THE INVENTION

Figure 1A:
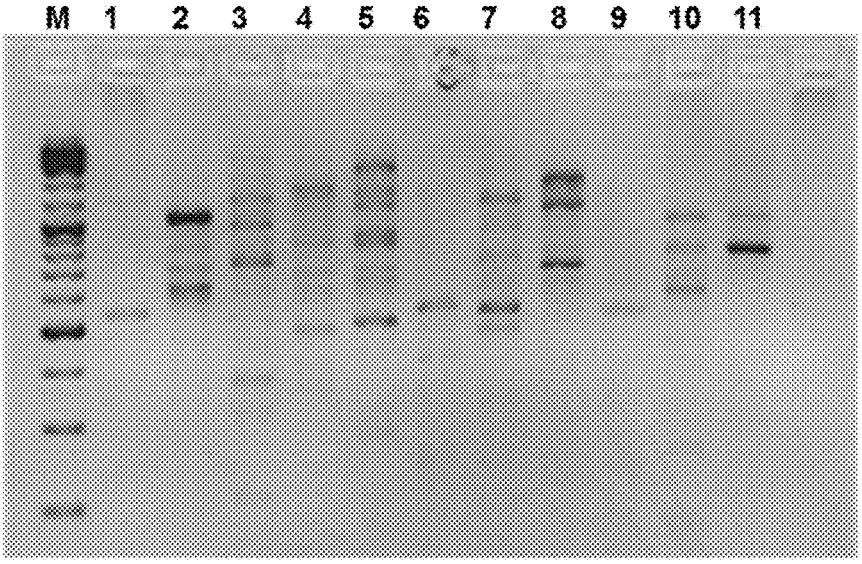
FIG. 1 gel electrophoretic separation of the RAPD fragments using primer 08/9328; the samples are labeled with assay numbers (table 1), the negative control (no template DNA) is designated N; the DNA molecular weight marker used was a 100 bp ladder (M)

Molecular Biological Determination of the Fungus Species

For the molecular biologic determination of *Physisporinus vitreus*, a clone-specific primer was designed and synthesized. As a result, a sensitivity of $10^{-5}$ can be achieved in a real-time polymerase chain reaction (real-time PCR, real-time PCR). The detection of *P. vitreus* by the use of species-specific primers in combination with fungus DNA extraction techniques directly from wood is considerably simplified, since in carrying out such identification a normal standard PCR followed by gel electrophoresis is sufficient. The time requirement for this process is a few hours, which therefore is much faster and more effective compared to the conventional method because one can avoid production of pure cultures. Moreover, the risk of extraneous contamination during sampling is significantly minimized by the use of the specific primer pair.

For detecting the presence and penetration depth of *P. vitreus*, small samples were taken from the interior of the wood under sterile conditions and transferred to nutrient media in accordance with the conventional method. Subsequently, the samples were incubated in the climate chamber for several days and examined for mycelial growth of the fungus. The identifying features consisted of macroscopic and microscopic characteristics of the mycelium. This procedure requires several days up to weeks and involves risks of extraneous contamination, which make a (re-) identification of *P vitreus* more difficult. Molecular biological methods which were developed for the characterization of fungus species in the 1980's may serve as an alternative to this time-consuming process (Schmidt and Moreth, 2006).

In order to meet the above-mentioned quality criteria of a reliable identification method, strain-specific primers were constructed for the conclusive detection of the fungus species *P. vitreus*. In table 1 the fungus species used in these studies are listed. The DNA extraction for the molecular biological studies was carried out using the Extract-N-Amp™ Plant PCR Kit from the company Sigma Aldrich according to the manufacturer's instructions.

TABLE 1

Fungus species used

| Fungus species | Isolate-No. | Origin |
|---|---|---|
| 1 *Physisporinus lineatus* | CBS 701.94 | Centraalbureau voor Schimmelcultures |
| 2 *Physisporinus ulmarius* | CBS 186.60 | Centraalbureau voor Schimmelcultures |
| 3 *Physisporinus laetus* | CBS 101079 | Centraalbureau voor Schimmelcultures |
| 4 *Physisporinus sanguilentum* | CBS 193.76 | Centraalbureau voor Schimmelcultures |
| 5 *Physisporinus vinctus* | CBS 153.84 | Centraalbureau voor Schimmelcultures |
| 6 *Physisporinus rigidus* | CBS 160.64 | Centraalbureau voor Schimmelcultures |
| 7 *Physisporinus vitreus* | EMPA 642 | BFH-Hamburg |
| 8 *Physisporinus vitreus* | EMPA 643 | Albert-Ludwigs-Universität Freiburg |
| 9 *Physisporinus vitreus* | EMPA 674 | BFH-Hamburg |
| 10 *Physisporinus vitreus* | EMPA 675 | BFH-Hamburg |
| 11 *Physisporinus vitreus* | EMPA 676 | Centraalbureau voor Schimmelcultures |

Figure 1B:
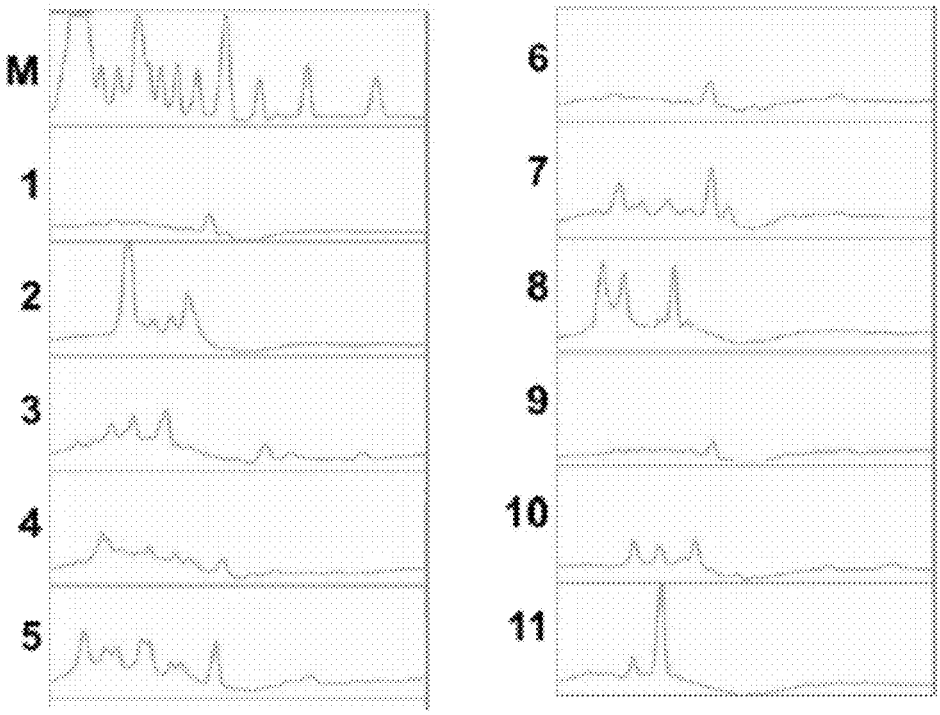

In the first step, a RAPD (Randomly Amplified Polymorphic DNA) PCR was carried out for strain differentiation of the fungus species used. By using very short oligonucleotide primers, specific DNA band patterns are generated by PCR in this method and used for differentiation. These are some of the most common methods for carrying out a quick kinship analysis and identifying different isolates of a species (Schmidt and Moreth, 1998; Schmidt and Moreth, 2006). In total, DNA samples from 11 fungus species (table 1) were amplified with 10 random 10mer primers, and the electrophoretically separated band patterns were evaluated (FIG. 1).

For the development of a specific primer pair for *P. vitreus*, the ITS1-5,8S-ITS2 region of the fungus species used was first amplified by means of the ITS 1/ITS 4 primer combination of White et al. (1990) using a thermocycler of the company Biometra. Ribosomal DNA (rDNA) was the target region of the primers used. It consists, inter alia, of coding gene segments 18S-, 5.8S- and 28S rRNA (in fungus species and other eukaryotes) that are conservative (Schmidt and Moreth, 2006). These three coding gene segments are separated from each other by highly variable introns, the Internal Transcribed Spacers (ITS1 and ITS2).

The PCR products thus obtained were then commercially purified and sequenced (Synergene, Zürich). The sequence of the ITS region of *P. vitreus* 642 has been deposited in the international database EMBL (Accession No. FM202494). Due to the species specificity of the ITS region, the sequence of *P. vitreus* 642 was used to isolate short DNA sequences (20 bases) that occur exclusively in the fungus species *P. vitreus* by means of the program Clustal X and the Basic Local Alignment Search Tool (Primer-BLAST) of the National Center for Biotechnology Information (NCBI, http://www.ncbi.nlm.nih.gov/tools/primer-blast/). These short DNA sequences were synthesized (Microsynth) and used as a *P. vitreus*-specific primer pair. Thus, *P. vitreus* is no longer distinguished solely by a band pattern, but by a species-specific PCR in which only DNA from *P. vitreus*, for which the primer pair was constructed, allows the generation of a PCR product of 426 base pairs. This evaluation or differentiation is unambiguous because it produces only either a positive or a negative result (Schmidt and Moreth, 2000; Schmidt and Moreth, 2006).

Deposition of Biological Material

A sample of the above-mentioned strain *Physisporinus vitreus* EMPA 642 has been successfully deposited on Oct. 16, 2015 with the Centraalbureau voor Schimmelcultures Fungal Biodiversity Centre (CBS-KNAW), Uppsalalaan, 3584 CT, Utrecht, The Netherlands, an approved depository facility (International Depository Authority (IDA)) according to Budapest Treaty since 1981. The deposited material has been assigned accession number FM202494 on Oct. 23, 2015.

EXAMPLES

1. Cultivation of Fungus Species

For cultivation of fungus species, *Physisporinus vitreus* (EMPA strain no. 642 or 643) was pre-cultivated on a suitable, sterile malt agar culture medium in Petri dishes (Ø 9 cm). As soon as the culture medium was completely overgrown by the fungus mycelium of *P. vitreus* (after about 12 to 16 days), about 2 g of sterile spruce sawdust (particle size <2 mm) was placed in the middle of the medium in each Petri dish under sterile conditions. After a further 4 to 6 weeks, the sawdust substrate, completely grown through with *P. vitreus*, was used to inoculate the liquid medium.

1.1 Composition of the Nutrient Substrate

Malt extract 40 g/liter

Agar (pure) 25 g/liter 1.2 Incubation Conditions

22° C. and 70±5% rel. humidity (in the dark)

1.3 Preparation of Liquid Medium

A nanofibrillated cellulosic nutrient medium has proven to be a particularly suitable liquid medium for the cultivation of *P. vitreus* on the basis of preliminary experiments.

2. Composition of the Nutrient Medium

In tap water with 10% spruce wood extract[1]):

[1]) Spruce wood extract (about 200 g spruce wood sawdust in 1 liter of tap water boiled for 30 minutes; left to stand at room temperature for 24 hours and filtered off)

300 g of nanofibrillated cellulose/liter 5.0 g malt extract/liter 7.1 g KCl/liter 2.1 Inoculation of the Liquid Medium 1200 ml of nanofibrillated cellulose-containing liquid medium was sterilized in a steam autoclave for 20 to 30 minutes at 121° C. and inoculated with about 100 ml fungus species containing liquid medium culture (with the same composition) (not older than 8 weeks) or, in case of the inoculation of a first liquid medium culture, with fresh sawdust particles grown through fungus species (about 1 to 2 g) as described in paragraph 2 with *P. vitreus*.

2.2 Incubation

The Incubation of the nanofibrillated cellulose-containing liquid medium was carried out under sterile conditions with *P. vitreus* in a bioreactor under controlled pH conditions (pH adjusted to 6.8 to 7.2, optionally under controlled oxygen supply). The rotational speed of the stirrer was adjusted to "low". Alternatively, the nutrient medium can also be produced as a standing or shaked culture in suitable Erlenmeyer flasks with cotton stoppers on a horizontal shaker (50 u/min) for 4 to 8 weeks in a climatic chamber in the dark at 22° C. and 70±5% relative humidity.

3. Fungus Treatment of Spruce Wood

The introduction of the fungus containing liquid medium and the actual exposure time or fungus treatment of the spruce wood (violin cover boards made of spruce wood) was carried out under sterile conditions in a specially prepared incubator.

3.1 Construction of the Incubator

The incubator consists of a heat-resistant container made of plastic (PPC) with internal dimensions of 554 mm×354 mm×141 mm (supply source: WEZ Kunststoffwerk AG, CH-5036 Oberentfelden; Art. Nr. 6413.007) and a corresponding, modified cover plate made of sight glass. In this incubator, there were situated two treatment containers made of stainless steel which were adapted in their dimensions and shape to the resonance wood blanks (violin cover) to be treated and appropriately inserted holders (support devices) each with a corresponding filling tube with 3 to 4 outlet apertures, which are connected to a pipe system (made of heat-resistant material) and an inlet valve within the incubator container. This construction allows to fill the fungus-containing liquid medium into the incubator under sterile conditions.

3.2 Preparations Before Introducing the Liquid Medium

The two resonance wood blanks to be treated (for a violin cover) were introduced in the appropriate support devices within treatment containers made of stainless steel. The total amount of the fungus containing liquid medium subsequently required for filling can be reduced by optionally filling a few glass beads as placeholders (volume displacer) in the lower part of the treatment container.

The filling pipes were connected to the inlet valves within the incubator.

The incubator was tightly closed with a cover plate (made of sight glass) and the entire container including the resonance wood blanks placed therein was sterilized under low heat action, e.g. by means of ionizing radiation.

3.3 Introduction of the Fungus Containing Liquid Medium

The incubator previously sterilized and equipped with the resonance wood blanks (violin covers) to be treated was subjected to a 10% reduced pressure (about 100 mbar) under sterile conditions. Due to the reduced pressure in the incubator, the fungus containing liquid medium can be fed via the filling tube into the treatment container with the resonance wood blanks under sterile conditions via the previously also sterilized plastic tubes and valves, which are directly connected to the bioreactor or to a shaked or standing culture.

As soon as the resonance wood blanks are uniformly covered with a layer of fungus containing liquid medium having a thickness of about 5 to 10 mm (detectable through the sight glass of the cover plate), the supply line was stopped and the supply tubes were emptied. The incubator was then vented to normal pressure by means of a valve provided with a sterile microfilter and incubated as a whole in a suitable air conditioning cabin for the intended fungus treatment (exposure time).

3.4 Incubation of Freshly Cut, Fungus-Treated and Old Spruce Wood Samples

Twin samples with dimensions of 12×2.5×150 mm (radial×tangential×longitudinal) taken from a red spruce tree (*Picea abies* L.). The tree was felled in autumn 2009 in the Sufers region. The raw density of the wood was 370 kg/m$^3$ with a relative wood humidity of 65%. The wood samples had narrow tree rings and the resonance wood could be assigned to the quality grading 'master fine'. A few wood samples were used as untreated controls, the others were incubated with *P. vitreus* in the dark at 22° C. and 70% relative humidity. For the purpose of comparative studies, old wood samples were taken from a cello (year of construction 1700, violin maker Catenes) and from a beam of a historic house in Rougemont (dated 1756, Switzerland) which was used for the construction of a cello. At a relative humidity of 65%, the raw density of the wood samples of Testore and Rougemont was 410 and 456 kg/m$^3$. Moreover, twin samples of narrow- and wide-ringed wood were examined before and after fungus treatment. Moreover, samples of wide- and narrow-ringed wood were prepared.

Of all the wood samples, preparations with a cutting thickness of 0.06 mm, a length of 15 mm and a width of 1.5 mm were produced with a rotation microscope before and after the treatment. The incubator including the wood samples surrounded by the fungus containing, nanofibrillated-cellulose-containing liquid medium was incubated for the required exposure time (fungus treatment) in a suitable air conditioning cabin at 22° C. (and 70±5% relative humidity) for 12 months. In intervals of 2 to 4 weeks, fresh, oxygen-rich air was supplied under sterile conditions through the valve with the sterile microfilter. After a 12-month incubation period, the wood samples were cleaned and then sterilized with ethylene oxide. From each sample variant, a minimum of 5 replicates were tested in a micromechanical measuring device for determining the stress relaxation. Subsequently, the samples were analyzed in a Fourier Transform Infrared (FT-IR) Spectrometer and by means of Dynamic Water Vapor Sorption (DVS).

4. Sampling and Post-Treatment of the Modified Wood

After the fungus treatment, the incubator is opened. The fungus-treated wood samples laying in the treatment container were removed from the nanofibrillated cellulosic liquid medium that was completely intermingled with fungus myecelium and were carefully cleaned mechanically (with a metal spatula) from superficially adhering mycelium.

4.1 Drying of the Spruce Wood After the Fungus Treatment

The freshly removed, fungus-modified resonance wood blanks (violin covers) have a relatively high water content, in some cases more than 150 to 250%, and have to be subsequently dried gently to avoid cracking (ring peeling).

For this purpose, the spruce boards were initially stored in a climate chamber (20° C.) and with 80% relative humidity (eventually previously in a container with a xylene-containing atmosphere to prevent the growth of mold fungus) and were then successively dried down over a period of several weeks in a climate chamber at 65% and later at 50% relative humidity.

4.2 Sterilization of the Fungus-Treated Resonance Wood Blanks

After drying and prior to the processing of the fungus-modified resonance wood blanks for instrument making, they may optionally be sterilized, e.g. with ionizing radiation (under low heat action).

5. Mass Losses in Fungus-Treated Wood

Figure 2:
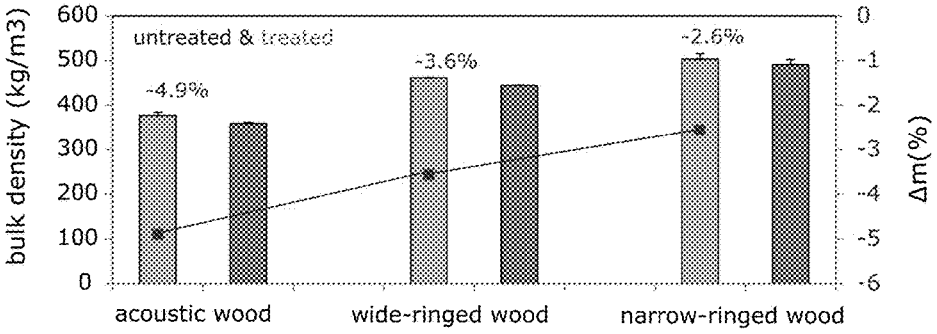
FIG. 2 mass losses in wood samples after 12 months of incubation with *Physisporinus vitreus*: raw density $\rho_R$ (bars) and mass loss Δm (line with squares) for three different types of wood.

The raw density $\rho_R$ of the various wood samples before and after the fungus treatment is shown in FIG. 2. The average mass loss $\Delta m$ of the fungus-treated wood samples is 3.3%±0.9%. From FIG. 2 it can be seen that with declining raw density of the wood the mass losses decrease. The highest mass losses were found in the high-quality resonance wood (low raw density), the lowest mass losses were found in the inferior wood (high raw density).

6. Stress Relaxation in Fungus-Treated Wood

Figure 3A:
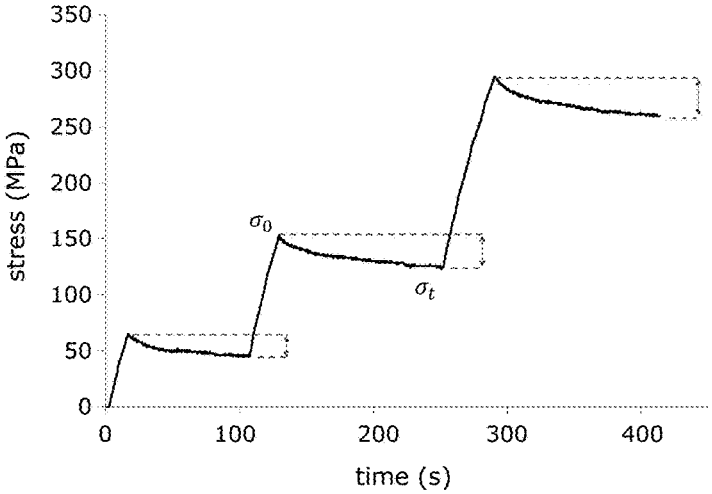
FIG. 3 (*a*) example of the relaxation of stress σ in the wood as a function of time; (*b*) photograph of a wood sample before and after microbending load.
Figure 3B:
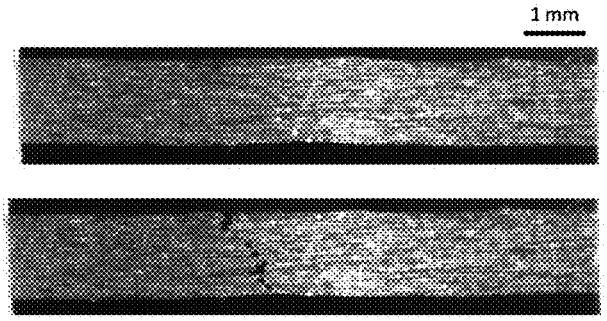

Micromechanical investigations were carried out under bending load according to Burgert et al (2003). The thickness of the wood samples was determined in the middle and on the sides of the samples with a micrometer caliper. The width and the length (~10 mm) were measured with a transmitted light brightfield microscope. The samples were loaded with a maximum load of 50 N and the experiments were carried out at a speed of 1 μm/s (FIG. 3). At certain load levels, the motor was turned off for 120 seconds in order to measure the stress relaxation. The relative stress relaxation was calculated as follows:

$$\frac{\sigma_0 - \sigma_t}{\sigma_0}$$

wherein $\sigma_0$ is the initial tension and $\sigma_t$ is the tension after 120 seconds relaxation.

Figure 4:
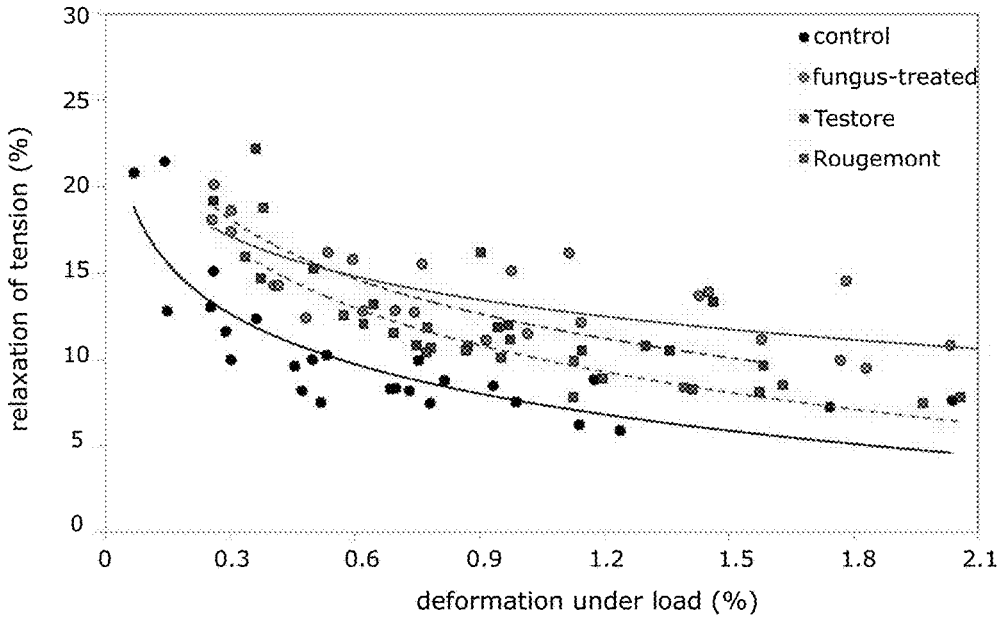
FIG. 4 stress relaxation as a function of deformation under load in freshly cut wood (control), in fungus-treated spruce wood and in old wood samples (Testore, Rougemont)

In FIG. 4 the stress relaxation of freshly cut wood (control), fungus-treated wood and old wood is compared. The stress relaxation was calculated from the reduction between the initial and the effective stress after 2 minutes. Although a certain scatter of the measured data was found (coefficient of determination: R=0.6-0.82), it is undoubtedly evident that the fungus-treated wood has a higher stress relaxation than freshly cut wood.

The time-dependent mechanical behavior of a material such as e.g. the stress relaxation allows conclusions to be drawn about the size and reorientation of important cell elements at different temporal and spatial levels (Cosgrove 1993). In the micromechanical stress relaxation tests, a gradual decrease was observed, which presumably results from the reorientation of various cell wall constituents in the wood. We suspect that there is a reorientation of the wood fibers that are connected to each other by the middle lamella, wherein the delay results from the incorporation of the cellulosic fibrils into the amorphous matrix of hemicellulose and lignin. The differences in the relaxation behavior between freshly cut wood, fungus-treated wood and old wood suggest that a material degradation takes place at the submicroscopic level, which is mainly due to the degradation of lignin and hemicellulosis. This results in a stress relaxation in the wood (Köhler et al, 2002; Sedighi Gilani and Navi 2007). The degradation of the cell wall matrix (hemicellulose and lignin) around the embedded cellulose fibrils in turn has an influence on the vibration properties or changes the damping properties of the wood (Noguchi et al. 2012).

7. Sound Emission and Damping

Figure 5:
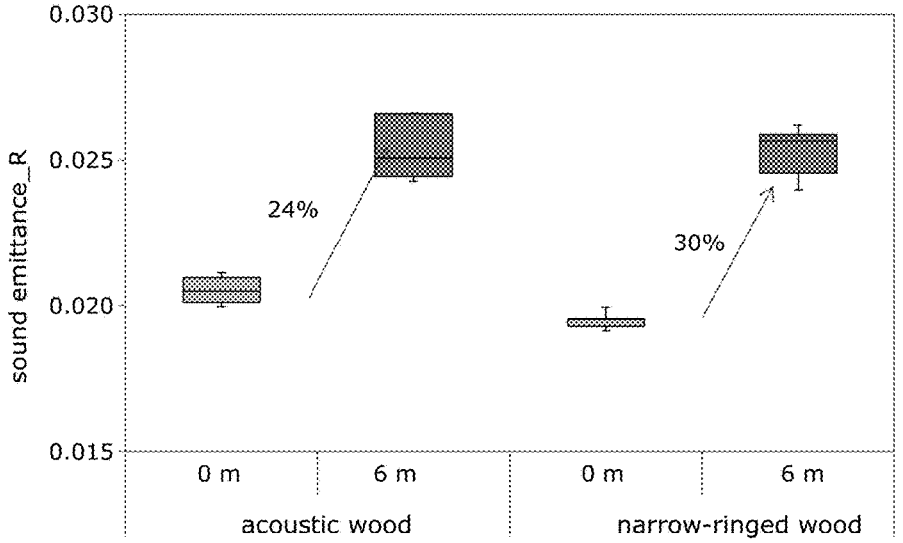
FIG. 5 increase of the acoustic radiation in the longitudinal direction in wood samples after 12 months incubation with *Physisporinus vitreus;*
Figure 6:
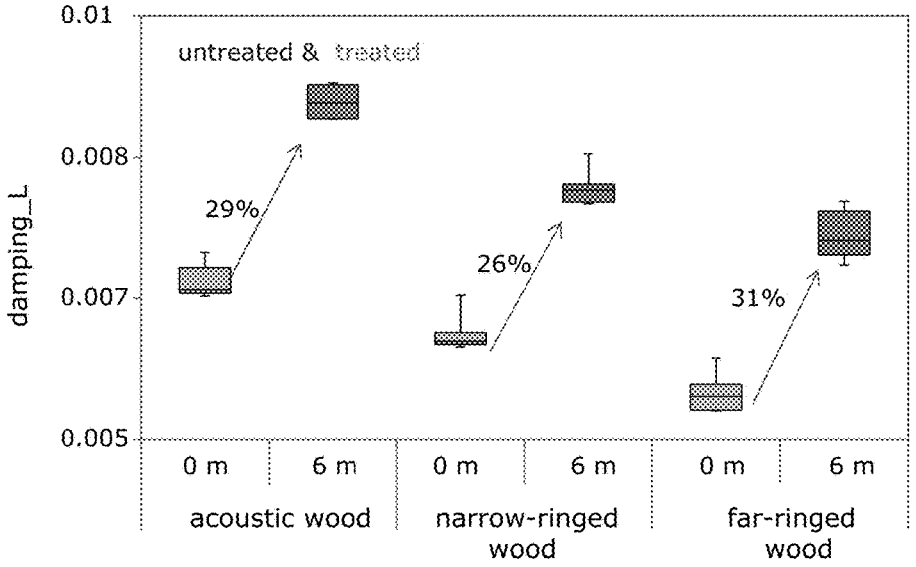
FIG. 6 increase of the damping property in longitudinal direction in wood samples after 12 months incubation with *Physisporinus vitreus;*

The most important acoustic properties that are used for the selection of resonance wood for musical instruments are the damping (tan δ) and the sound emission (R). High-quality resonance wood has a high sound emission (R). R describes how strongly the vibrations of a body are damped due to the sound emission. On the other hand, the damping of the sound describes any kind of reduction of the sound intensity, which does not necessarily have to be associated with a reduction of the sound energy, for example by divergence, i.e. by a spread of the sound energy over a larger area. Both properties were examined on untreated controls and on fungus-treated wood. The vibration characteristics of wood samples were measured before and after fungus treatment (as described under 5.4) at a relative moisture content of 65%. The results show that both the sound emission and the damping significantly increase in the fungus-treated wood (FIG. 5-6).

8. Color Measurements

The color measurements were carried out on wood samples with a tristimulus colorimeter (Konica Minolta) at wavelengths between 360 to 740 nm. The device allows for a non-contact measurement of brightness and color at a measuring angle of 1°. The color coordinates were determined for fungus-treated and freshly cut wood and the color index was calculated as follows:

$$E^* = \sqrt{(L^*)^2 + (a^*)^2 + (b^*)^2}$$

wherein L* defines the brightness from 0 (black) to 100 (white) while a* defines the ratio of red (+60) to green (−60) and b* the ratio of yellow (+60) to blue (−60).

Figure 7A:
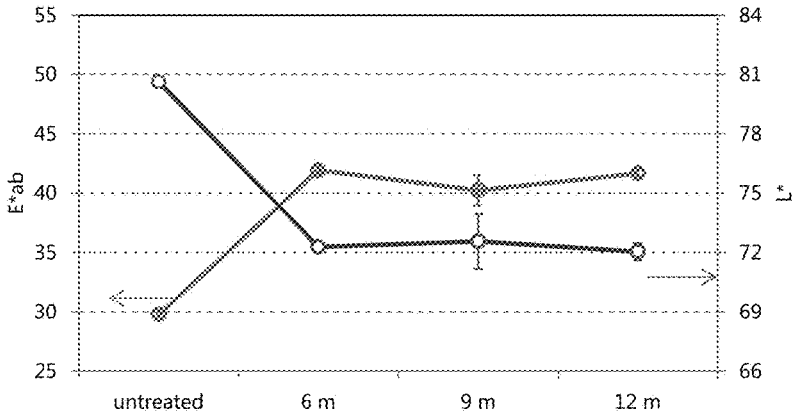
FIG. 7 change in the total color (green) and brightness (gray) of resonance wood (a) and lumber (b) after different durations (4-12 months) of the fungus treatment or storage time; (c) freshly cut wood (top), 12-month fungus-treated samples (middle), old wood samples from Rougemont (bottom)
Figure 7B:
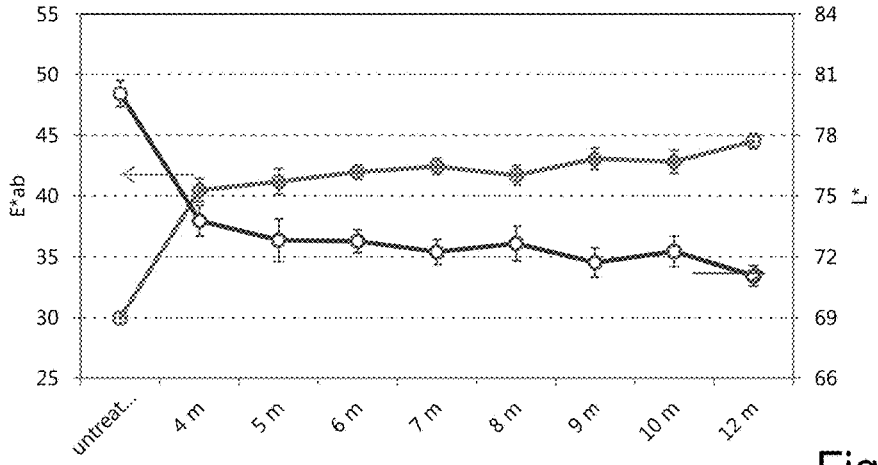
Figure 7C:
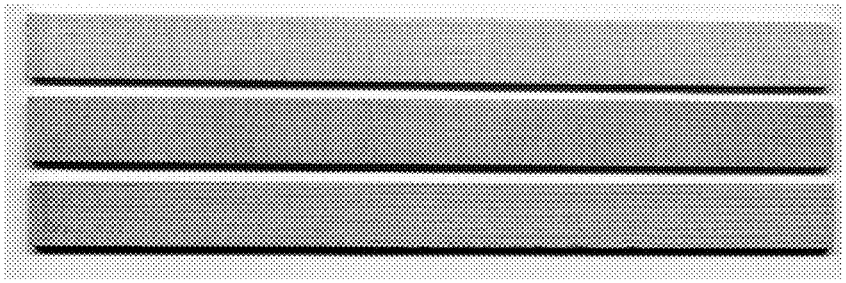

FIG. 7 shows the color index $E^*_{ab}$ and the brightness L* for freshly cut and for fungus-treated resonance wood (a) and lumber (b) after 4 to 12 months. As the duration of the fungus treatment increases, the color index increases while the brightness decreases. In the original state, an E* index of 29.9 (±0.8) was found for freshly cut resonance wood (a) and lumber (b) (FIG. 7*a-b*). After 12 months of fungus treatment, there was an increase in the E* index by 44.5 (±1.2) for fungus-treated resonance wood (FIG. 7*a*) and by 41.6(±0.6) for fungus-treated lumber (FIG. 7*b*).

From an aesthetic point of view, a high color index (E*) is advantageous in violin making, since the wood has an older color appearance after the fungus treatment. Comparative studies with color measurements on old wood samples (Rougemont from 1756, Switzerland) have shown a color index E*=37.2 and a brightness index L*=73.7.

However, the color changes of interest here are usually described not only by the change of the value of E*, which is by definition the length of a vector in the color space spanned by L*, a* and b*. Of informative value is, in particular, also the length of the change vector ΔE*, which connects the color point ($L_0$*, $a_0$*, $b_0$*) before color change with the color point ($L_1$*, $a_1$*, $b_1$*) after color change:

$$\Delta E^* = \sqrt{(L^*_1 - L^*_0)^2 + (a^*_1 - a^*_0)^2 + (b^*_1 - b^*_0)^2}$$

Figure 8:
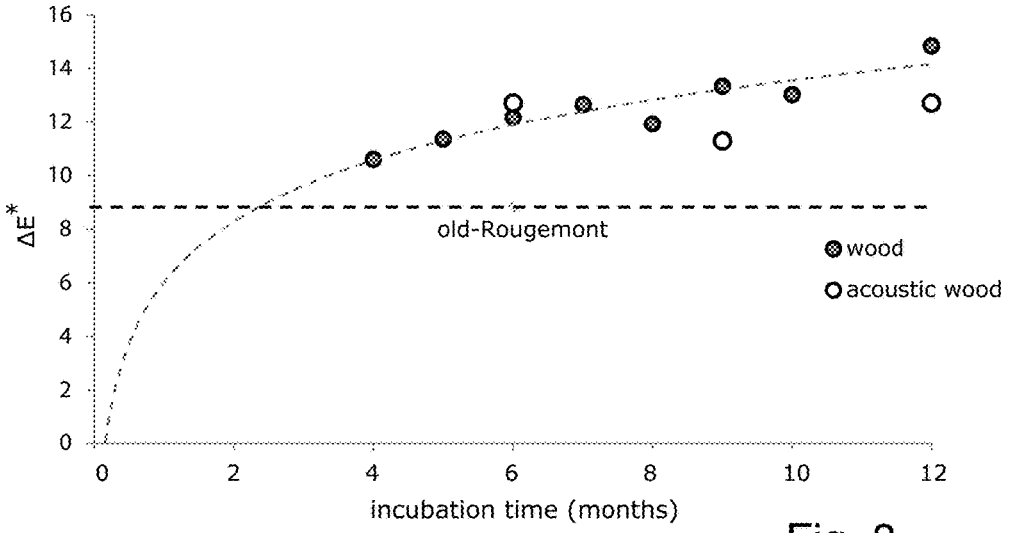
FIG. 8 color distance ΔE* of resonance wood (open circles) and lumber (filled circles) after different durations (4-12 months) of the fungus treatment compared to the untreated condition; the dashed line shows the color distance of an old wood sample (Rougemont) compared to a freshly cut sample of the same type of wood.

The quantity ΔE* is also called color distance. In FIG. 8 there is shown the time course of the color distance ΔE* of resonance wood (open circles) and lumber (filled circles) after different durations (4 to 12 months) of the fungus treatment compared to the untreated state. For comparison, the dashed line shows the color distance of an old wood sample (Rougemont) compared to a freshly cut sample of the same wood species.

9. FT-IR Analyses

Figure 9:
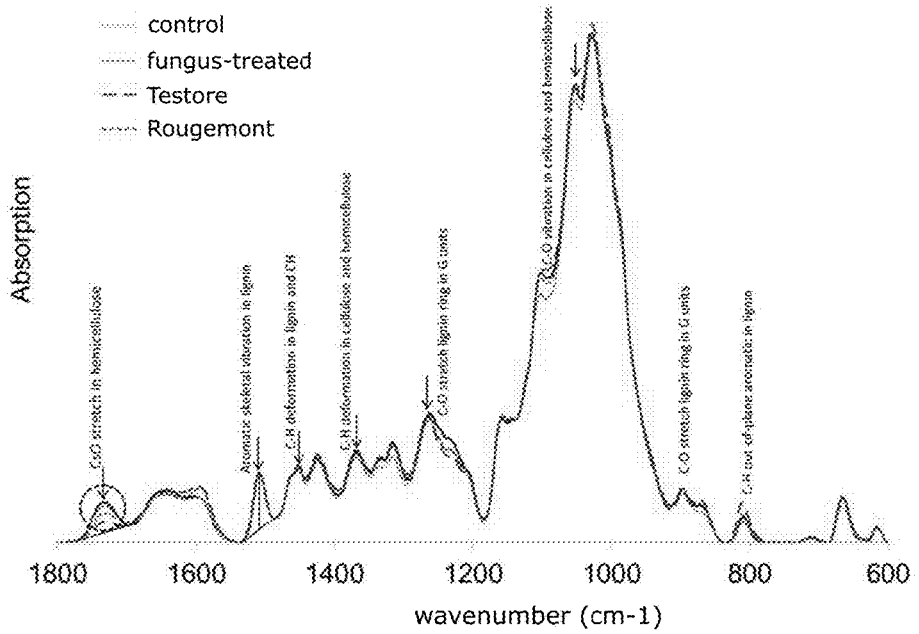
FIG. 9 qualitative comparison of FT-IR spectral absorption for untreated wood (control), 12-month fungus-treated wood and old wood (Testore and Rougemont) at different wavenumbers. At a wavenumber of 1508 and 1738 $cm^{-1}$, peak values were measured (dashed lines).

FIG. 9 shows the FT-IR spectra of fungus-treated wood and of freshly cut wood and also of old wood (Testore and Rougemont) in the region 1800-800 $cm^{-1}$, wherein the absorption at 1508 $cm^{-1}$, that originates from the aromatic ring vibration (C=C) of lignin, has been normalized. In the old wood, there is a significant increase in the lignin polysaccharide ratio at a wavenumber of 1738 $cm^{-1}$, which results from the degradation of hemicellulose (Garcia Esteban et al. 2006, Nagyvary et al. 2006, Ganne-Chédeville et al. 2012). Similar degradation processes were found by means of FT-IR also on the fungus-treated wood. The measurements showed that the absolute values at wavenumbers 818, 589 and 1051, which are representative of hemicellulose and lignin, were reduced. Although the degradation processes of the polysaccharides and lignin are not identical under the fungus treatment and with natural aging, it can be assumed that the physical properties and the sorption behavior, and also the swelling and shrinkage behavior, respectively, are similar to those of freshly cut wood.

Compared to freshly cut wood, FTIR analyses revealed significant changes in the ratio of lignin/polysaccharides in fungus-treated and old wood (Lehringer et al. 2011; Sedighi Giliani et al. 2014a; Sedighi Gilani et al. 2014b). A significant difference was the lower proportion of hemicellulose in old wood. Qualitative studies confirm that both lignin and hemicellulose are degraded at different rates during the delignification of the wood (Lehringer et al. 2011). Although the degradation processes of lignin and hemicellulose after selective delignification and natural aging are not identical, it can be assumed that their composition differs significantly from freshly cut wood. Presumably, the different composition of freshly cut wood has an influence on the interaction with moisture, e.g. sorption dynamics, moisture capacity and structural stability of the material. These changes will also have an impact on the wood anatomy and the supermolecular structure of the cell walls, which in turn have a significant impact on the vibromechanical properties of the wood. Studies show that increasing anatomical homogeneity of the wood structure has advantageous influences on the vibration properties, bending stiffness and damping of the wood (Jakiela et al., 2008, Stoel and Borman, 2008).

When water molecules penetrate into the lignified cell wall, they are absorbed by the surfaces of the cellulose microfibrils and the matrix consisting of lignin and hemicellulose. The absorption of water molecules via the hydroxyl groups between the wood polymers results in a reduction in flexural rigidity of hemicellulose and lignin in the cell wall, which affects the vibration and mechanical properties of the material. The damping of the wood is significantly increased with increasing relative humidity (Hunt and Gril 1996, Sedighi Gilani et al 2014b), which has a negative effect on the resonance properties of the wood. The degradation of hemicellulose in old and fungus-treated wood reduces the influence of moisture sorption on vibration and mechanical properties of the material (mechano-sorptivity). This finding has recently been confirmed in wood incubated with *P. vitreus* (Sedighi Gilani et al 2014 b). Another consequence of the lignin and hemicellulose degradation in the cell walls is the increased exposition of the crystalline cellulose and improved sorption stability of the wood. Compared to freshly cut wood, an accelerated diffusion process of water molecules could be shown on old and fungus-treated wood by means of dynamic sorption tests (Sedighi Gilani et al 2014 b).

It is likely that higher material stability during a moisture exchange with the atmosphere will improve the reliability of the vibration properties and the time-dependent mechanical properties of the wood, e.g. stress relaxation and creep behavior (Hunt and Gril 1996).

The method of fungal wood modification described herein leads to a temporal reduction in the stress relaxation of the material under various mechanical stress conditions (e.g. tuning) and physical stress conditions (e.g. air humidity fluctuations), which is of critical importance for the stability and resonance quality of musical instruments that are produced from wood. The striking similarities between naturally aged and fungus-treated wood show that the fungus treatment is a valuable wood modification process for the accelerated aging of resonance wood. The success of a fungus-treated violin in the blind test at the Osnabrück Baumpflegetagen in 2009 is very likely attributable to the similarity of mechanical and hygroscopic stability of fungus-treated and old wood.

REFERENCES

Anon. (2009) The biotech Stradivarius. Nature Biotechnology News 28: 6.

Barlow C Y, Edwards P P, Millward G R, Raphael R A, Rubio D J. (1988) Wood treatment used in Cremonese instruments. Nature 332: 313.

Bucur V. (2006) *Acoustics of wood,* 2nd edn. Berlin, Germany: Springer Series in Wood Science Springer, Heidelberg 407 S.

Burckle L, Grissino-Mayer H D. (2003) Stradivaris, violins, tree rings, and the Maunder Minimum: a hypothesis. Dendrochronologia 21:41-45.

Burgert I, Frühmann K, Keckes J, Fratzl P, Stanzl-Tschegg S E. (2003) Microtensile Testing of Wood Fibers Combined with videoextensometry for efficient Strain Detection. Holzforschung 57: 661-664 1.

Bryne E., Lausmaa J, Ernstsson M, Englund F, Wallinder M E P. (2010) Ageing of modified wood. Part 2: Determination of surface composition of acetylated, furfurylated, and thermally modified wood by XPS and ToF-SIMS. Holzforschung 64:305-313.

Cosgrove D J. (1993) Wall extensibility: its nature, measurement and relationship to plant cell growth. New Phytol 124:1-23.

Dimigen H, Dimigen E. (2014) Zum Alterungsverhalten von Tonholz Holztechnologie 1:16-21.

Esper J, Cook E R, Schweingruber F H. (2002) Low-frequency signals in long tree-ring chronologies for reconstructing past temperature variability. Science 295: 2250-2252.

Ebrahimzadeh P R, Kubat D G. (1993) Effects of humidity changes on damping and stress relaxation in wood. J Mater Sci 28: 5668-5674.

Ganne-Chédeville C, ääskelänen A S, Froidevaux J, Hughes M, Navi P. (2012) Natural and artificial ageing of spruce wood as observed by FTIR-ATR and UVRR spectroscopy. Holzforschung 66:163-170

Garcia Esteban L, Fernandez F G, Casasus A G, De Palacios P, Gril J. (2006) Comparison of the hygroscopic behaviour of 205-year-old and recently cut juvenile wood from Pinus sylvestris L. Ann For Sci 63: 309-317

Gug R. (1991) Choosing resonance wood. The Strad 102: 60-64.

Hunt D G, Gril J. (1996) Evidence of a physical ageing phenomenon in wood. J Mater Sci Lett 15:80-92

Holz D. (1966) Untersuchungen an Resonanzhölzern. 1. Mitteilung: Beurteilung von Fichtenresonanzhölzern auf der Grundlage der Rohdichteverteilung and der Jahrringbreite. Archiv für Forstwesen 15: 1287-1300.

Jakiela S, Bratasz L, Kozlowski R. (2008) Numerical modeling of moisture movement and related stress field in lime wood subjected to changing climate conditions. Wood Sci. Technol. 42, 21-37.

Kataoka Y, Kiguchi M. (2001) Depth profiling of photo-induced degradation in wood by FT-IR microspectroscopy, J Wood Sci 47:325-327.

Köhler L, Spatz H C. (2002) Micromechanics of plant tissues beyond the linear-elastic range, Planta, 215: 33-40

Lehringer C, Koch G, Adusumalli R B, Mook W M, Richter K, Militz H. (2011) Effect of *Physisporinus vitreus* on wood properties of Norway spruce. Part 1: aspects of delignification and surface hardness. Holzforschung 65:711-719

Matsuo M, Yokoyama M, Umemura K, Sugiyama J, Kawai S, Gril J, Kubodera S, Mitsutani T, Ozaki H, Sakamoto M, Imamura M. (2011) Aging of wood: analysis of color changes during natural aging and heat treatment. Holzforschung 65:361-368.

Meyer H G. (1995) A practical approach to the choice of tone wood for the instruments of the violin family. Catgut Acoustical Society Journal 2: 9-13.

Müller H A. (1986) How violin makers choose wood and what this procedure means from a physical point of view. In: Hutchins C M, ed. *Research Papers in Violin Acoustics:* 1975-1993, volume 1. Woodbury, N.Y., USA: Acoustical Society of America, paper 92.

Nagyvary J, DiVerdi J A, Owen O I, Dennis Tolley H. (2006) Wood used by Stradivari and Guarneri. Nature 444, 565.

Noguchi T, Obataya, E, Ando K. (2012) Effects of aging on the vibrational properties of wood. Journal of Cultural Heritage 13: 21-25.

Ono T, Norimoto M. (1983) Study on Young's modulus and internal friction of wood in relation to the evaluation of wood for musical instruments. Japan Journal of Applied Physics 22: 611-614.

Ono T, Norimoto M. (1984) On physical criteria for the selection of wood for sound-boards of musical instruments. Rheol Acta 23: 652-656.

Pfriem A, Eichelberger K, Wagenführ A. (2007) Acoustic properties of thermally modified spruce for use of violins. J Violin Soc Am 21:102-111.

Roth K. (2009) Das chemische Geheimnis der Geigenvirtuosen Mit Stradivari, Kunstsaiten and Kolophonium. Chem. Unserer Zeit 43: 168-181.

Schleske M. (1998) On the acoustical properties of violin varnish. Catgut Acoustical Society Journal 3: 15-24.

Schmidt, O, MORETH, U. (1998). Characterization of indoor rot fungi by RAPD analysis. Holzforschung 52: 229-233.

Schmidt, O. Moreth, U. (2000). Species-specific priming PCR in the rDNA-ITS region as a diagnostic tool for *Serpula lacrymans*. Mycol. Research 104: 69-72.

Schmidt, O. Moreth, U. (2006) Molekulare Untersuchungen an Hausfäulepilzen. Zeitschrift für Mykologie 72:137-152.

Schwarze F W M R, Lonsdale D, Mattheck C. (1995) Detectability of wood decay caused by *Ustulina deusta* in comparison with other tree-decay fungi. European Journal of Forest Pathology 25: 327-341.

Schwarze F W M R, Spycher M, Fink S. (2008) Superior wood for violins—wood decay fungi as a substitute for cold climate. *New Phytologist* 179: 1095-1104.

Sedighi Gilani M, Navi P. (2007) Experimental observations and micromechanical modeling of successive-damaging phenomenon in wood cells tensile behavior. Wood Sci Technol, 41(1): 69-85.

Sedighi Gilani, M., Boone, M. N., Mader, K., Schwarze, F. W. M. R. (2014). Synchrotron X-ray micro-tomography imaging and analysis of wood degraded by *Physisporinus vitreus* and *Xylaria longipes* Journal of Structural Biology 187: 149-157.

Sedighi Gilani, M., Tingaut P., Heeb M., Schwarze, F. W. M. R. (2014). Influence of moisture on the vibro-mechanical properties of bio-engineered wood. Journal of Material Science. 49: 7679-7687.

Spycher M. (2008) The application of wood decay fungi to improve the acoustic properties of resonance wood for violins. PhD thesis. Freiburg, Germany: Albert-Ludwigs-Universität Freiburg.

Spycher M, Schwarze F W M R, Steiger R. (2008) Assessment of resonance wood quality by comparing the physical and histological properties. *Wood Science and Technology* 42, 325-342.

Stoel B C, Borman T M. (2008) Comparison of Wood Density between Classical Cremonese and Modern Violins. PLoS ONE 3: 1-7.

Topham T J, McCormick M D. (2000) A dendrochronological investigation of stringed instruments of the Cremonese School (1666-1757) including 'The Messiah' violin attributed to Antonio Stradivari. Journal of Archaeological Science 27: 183-192.

Wagenführ A, Pfriem A, Eichelberger K. (2005a) Der Einfluss einer thermischen Modifikation von Holz auf im Musikinstrumentenbau relevante Eigenschaften. Teil I: spezielle anatomische und physikalische Eigenschaften. Holztechnologie 46: 36-42.

Wagenführ A, Pfriem A, Eichelberger K. (2005b.) Der Einfluss einer thermischen Modifikation von Holz auf im Musikinstrumentenbau relevante Eigenschaften. Teil 2: technologische Eigenschaften, Herstellung und Prüfung von Musikinstrumentenbauteilen. Holztechnologie 47: 39-43.

Wegst U G K. (2006) Wood for sound. American Journal of Botany 93: 1439-1448.

White T J, Bruns T, Lee S, Taylor J. (1990) Amplification and direct sequencing of fungal ribosomal RNA genes for phylogenetics. In: *PCR Protocols: a Guide to Methods and Applications* (eds Innis M A, Gelfand D H, Sninsky J J, White T J), pp. 315-321. Academic Press, San Diego, Calif.

Windeisen E, Bachle H, Zimmer B, Wegener G. (2009) Relations between chemical changes and mechanical properties of thermally treated wood 10th EWLP, Stockholm, Sweden, Aug. 25-28, 2008. Holzforschung 63:773-778.

Yano H, Kajita H, Minato K. (1994) Chemical treatment of wood for musical instruments. Journal of the Acoustical Society of America 96: 3380-3391.

The invention claimed is:

1. A method for improving acoustic properties of spruce resonance wood for musical instruments comprising:

subjecting at least one resonance wood blank to a treatment with *Physisporinus vitreus* under controlled, sterile conditions to produce a sterilized resonance wood blank, wherein the previously sterilized resonance wood blank is immersed in a liquid medium enriched with fungus myecelium, kept therein in a dark environment for an exposure time and is subsequently sterilized, wherein during the exposure time a temperature of 18 to 26° C. and a relative humidity of approximately 60 to approximately 80% are maintained and wherein the liquid medium contains nanofibrillated cellulose (NFC) in an amount of 200 to 300 g per liter.

2. The method according to claim 1, wherein the treatment is carried out with *Physisporinus vitreus* EMPA 642.

3. The method according to claim 1, wherein during the exposure time a temperature of 21° C. to 23° C. and a relative humidity of approximately 65 to approximately 75% are maintained.

4. The method according to claim 1, wherein the exposure time is chosen in such manner that the resonance wood fulfils the following strength values:

a module for bending longitudinally to the fiber of at least 7 GPa;

a compressive strength longitudinally to the fiber of at least 24 $N/mm^2$; and a compressive strength transversely to the fiber of at least 3 $N/mm^2$.

5. The method according to claim 1, wherein the exposure time is 4 to 6 months.

6. The method according to claim 1, wherein the liquid medium has been obtained by incubation of an NFC-containing nutrient medium inoculated with *Physisporinus vitreus* under controlled pH conditions.

7. The method according to claim 1, wherein the sterilization of the resonance wood blank is carried out with ethylene oxide.

8. The method according to claim 1, wherein the method results in an increase in color index E* defined in the color space (L*, a*, b*) by at least 14.

9. The method according to claim 1, wherein the method results in a color change of the wood in form of a color distance ΔE* defined in color space (L*, a*, b*) of at least 11.

10. An improved spruce resonance wood for musical instruments which is produced by the method according to claim 1, wherein, compared to untreated resonance wood, sound emission in the longitudinal direction is increase by at least 20% and damping in the longitudinal direction is increased by at least 25%.

11. A musical instrument comprising at least one resonance plate made of improved spruce resonance wood according to claim 10.

12. The method according to claim 2, wherein during the exposure time a temperature of 21° C. to 23° C. and a relative humidity of approximately 65 to approximately 75% are maintained.

13. The method according to claim 2, wherein the exposure time is chosen in such manner that the resonance wood fulfils the following strength values:

a module for bending longitudinally to the fiber of at least 7 GPa;

a compressive strength longitudinally to the fiber of at least 24 $N/mm^2$; and a compressive strength transversely to the fiber of at least 3 $N/mm^2$.

14. The method according to claim 4, wherein the exposure time is chosen in such manner that the resonance wood fulfils the following strength values:

a module for bending longitudinally to the fiber of at least 10 GPa;

a compressive strength longitudinally to the fiber of at least 34 $N/mm^2$; and a compressive strength transversely to the fiber of at least 4.2 $N/mm^2$.

15. The method according to claim 13, wherein the exposure time is chosen in such manner that the resonance wood fulfils the following strength values:

a module for bending longitudinally to the fiber of at least 10 GPa;

a compressive strength longitudinally to the fiber of at least 34 $N/mm^2$; and a compressive strength transversely to the fiber of at least 4.2 $N/mm^2$.

16. The method according to claim 2, wherein the exposure time is 4 to 6 months.

17. The method according to claim 3, wherein the exposure time is 4 to 6 months.

18. The method according to claim 4, wherein the exposure time is 4 to 6 months.

19. The improved spruce resonance wood of claim 10, wherein, compared to untreated resonance wood, the sound emission in the longitudinal direction is increase by at least 24% and the damping in the longitudinal direction is increased by at least 29%.

20. The musical instrument of claim 11, wherein the musical instrument is a stringed instrument.

* * * * *